United States Patent [19]

Englund

[11] Patent Number: 4,567,458

[45] Date of Patent: Jan. 28, 1986

[54] THERMOSTATIC SWITCH

[75] Inventor: Richard L. Englund, King County, Wash.

[73] Assignee: Index Industries, Inc., Bellevue, Wash.

[21] Appl. No.: 641,038

[22] Filed: Aug. 15, 1984

[51] Int. Cl.[4] ..... H01H 37/54

[52] U.S. Cl. ..... 337/365; 337/372

[58] Field of Search ..... 337/365, 372, 375, 355, 337/345, 343, 89, 53, 343; 200/83 P, 83 N

[56] References Cited

U.S. PATENT DOCUMENTS

| | | | |
|---|---|---|---|
| 2,139,921 | 12/1938 | Weinhardt | 337/365 |
| 2,632,824 | 3/1953 | Malone | 337/365 |
| 3,322,920 | 5/1967 | Morris | 337/365 |
| 3,577,111 | 5/1971 | Nardulli | 337/89 |
| 4,103,271 | 7/1978 | Taylor et al. | 337/372 |
| 4,367,452 | 1/1983 | Carlson | 337/362 |

*Primary Examiner*—Harold Broome
*Attorney, Agent, or Firm*—Seed and Berry

[57] ABSTRACT

A thermostatic switch including a bimetallic disc movable between two oppositely dished configurations with a snap action in response to changes in temperature, and a tapered, resilient contactless arm fixedly attached by an anchored end to the perimeter of the disc and having a movable end. The movable end of the arm is moved with the disc between two positions corresponding to the disc configurations. The arm has a relatively low mass and minimal influence on the thermal operating characteristics of the disc. The thermostatic switch also includes a conductive plate with the disc positioned adjacent to the plate and the arm being in direct electrical contact with the plate when in a first arm position for conducting low current therebetween and being out of electrical contact with the plate when in a second arm position. A projecting portion of the movable end of the arm penetrates and wipes any surface contaminants on the plate when moved to the first arm position and is held in tight engagement with the plate and the disc when in the two arm positions to decrease vibration sensitivity. The current provides base drive to a power transistor which provides a switched, relatively high-current conduction path to which a load may be connected. The arm carries no contacts and conducts only low current.

21 Claims, 9 Drawing Figures

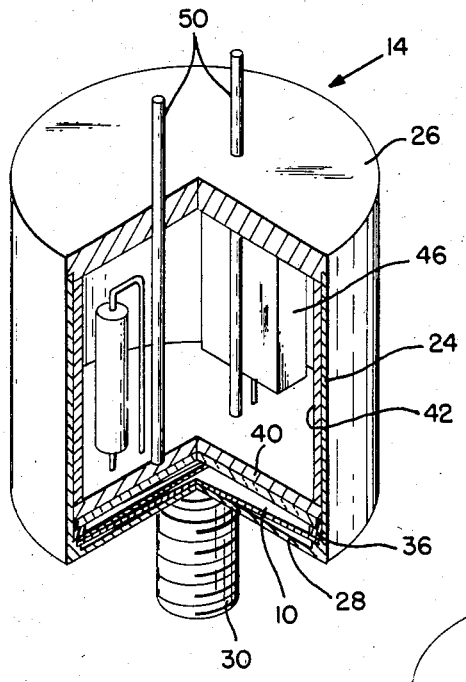
FIG. 1
FIG. 2
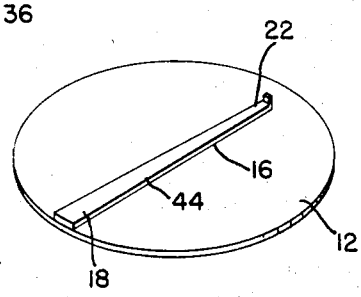
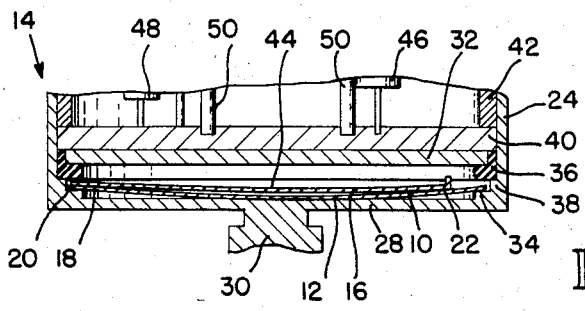
FIG. 3
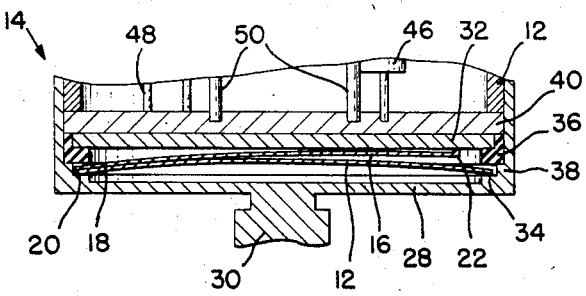
FIG. 4
FIG. 5
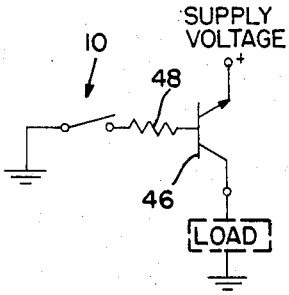

THERMOSTATIC SWITCH

DESCRIPTION

1. Technical Field

The present invention relates generally to temperature sensing bimetallic discs, and thermostatic switches using such discs.

2. Background Art

The thermal operating characteristics of bimetallic discs are well known and have frequently been employed in various contexts, including thermostatic switches. As is conventional in the art when bimetallic discs are used in electrical switching, the body of the disc engages an arm carrying a contact on its free end for movement of the contact into engagement with a fixed contact as the disc changes to an opposite concavity. The disc also provides the force necessary to maintain the desired contact pressure. The contact arm is biased to return to an unengaged, free position when the disc returns to its original concavity. While the disc provides the advantage of an inherent snap action as it moves between its two stable positions of opposite concavity in response to temperature change, having a contact at the end of the contact arm and using the disc to supply the contact pressure affects the thermal operating characteristics of the disc and the performance of the switch.

Bimetallic discs operate on heat induced stress which overcomes the convex or concave deformation of the disc and causes it to snap to its oppositely dished configuration. The disc of a thermostatic switch must, for any given application or design, apply a prescribed mechanical force to the movable contact arm. The amount of force depends upon several factors, such as the weight of the contact carried by the arm, the gap between the contacts when disengaged, the vibration capability requirements of the switch, the current to be conducted, the nature of the electrical load being switched, the minimum contact resistance required, the contact chatter which can be tolerated, and the like.

Contacts are generally fabricated from a precious metal and have an inherent weight. The larger the electrical currents to be switched or the more inductive the loads, the larger and heavier the contacts required. The larger the contact, the more force the disc must apply to the arm as the disc moves in response to temperature changes. Similarly, the disc must apply more force to the arm the larger the contact gap used. The force the disc applies to the arm must also increase if increased contact pressure is desired between the contact carried by the arm and the fixed contact to reduce vibration sensitivity, contact chatter, and contact resistance.

Of course, when the disc applies a force to the arm, an opposite force of equal magnitude is applied to disc as a reaction. Any such mechanical reaction force or other external mechanical loading force on the disc has an undesirable affect on the thermal operating characteristics of the disc. The larger the force, the more significantly the operating characteristics are affected. In particular, the operating temperature (the temperature at which the disc snaps from its one dished configuration to its oppositely dished configuration as temperature increases) changes when mechanical loading is applied. The reset temperature (the temperature at which the disc snaps back to its original position as the temperature decreases) also changes. Moreover, the accuracy of the disc, that is, the temperature range or tolerance about the nominal operating and reset temperatures within which the disc can be expected to change configurations, is adversely affected. A profound effect is also realized on the minimum differential or hysteresis achievable by the disc, as measured by the difference between the operating and reset temperatures. As a result, the operating characteristics of the disc, and hence the switch, change with the mechanical loading of the disc.

The repeatability of the disc is also known to depend on the mechanical loading forces applied to the disc from one cyclic operation of the disc to the next, and over the life of the disc. The mechanical forces applied change as a result of the mechanical components and electrical contacts repositioning themselves during usage or wearing from usage. The responsiveness and reliability of the switch are also adversely affected by increased contact weight and mechanical loading of the disc.

In thermostatic switches, it has been conventional to increase the force applied by the disc on the arm, and hence the mechanical loading force on the disc, to decrease switch chatter, vibration sensitivity and contact resistance. Similarly, it has been conventional to increase contact size to achieve large current switching capacity. While the result has been degradation of the thermal operating characteristics of the disc and performance of the switch, no alternative has been available.

It has been found that the thermal operating characteristics of switches manufactured in a mass production line setting vary significantly from one to the next. This is particularly so for switches which require numerous parts interacting together. Since the mechanical components making up the switch will vary within their manufacturing tolerances, and the precise mechanical loading on the disc depends on the mechanical components used, the thermal operating characteristics of the disc can vary significantly from one switch to the next. When a switch is required with operating and reset temperatures and a hysteresis within rigid tolerances, production yield decreases because of the variations between switches. The overall cost to produce acceptable switches is thereby increased. Moreover, the more parts used in the switch, particularly ones used in conjunction with the disc, the more inaccuracy, lack of repeatability, and unreliability is encountered.

Ideally, minimal mechanical loading forces should be applied to the disc. This would allow the switch to more closely achieve the thermal operating characteristics of the unloaded disc, and the inherent accuracy, repeatability, responsiveness and reliability of the disc. The switch should also be of simple and inexpensive construction and be capable of handling high currents with negligible influence on the thermal operating characteristics, accuracy, repeatability, responsiveness or reliability of the disc. The switch should have increased operating life, function well when switching inductive loads, and substantially eliminate the problems of contact resistance, contact chatter and vibration sensitivity. The present invention provides these and other related advantages.

DISCLOSURE OF THE INVENTION

The present invention resides in a thermostatic switch. The switch includes a conductive plate; a bimetallic disc movable between two dished configurations or positions of opposite concavity with a snap action in response to changes in temperature, and an electrically conductive, contactless resilient arm fixedly attached by an anchored end to the disc at a perimeter portion thereof. The disc is positioned adjacent to and spaced apart from the plate. The body of the disc is resiliently deformable, and the arm is of a different metallic composition than the disc.

The arm has a movable end which is moved with the disc between first and second positions corresponding to the two disc configurations. The movable end yieldably engages the plate in one position and the disc in the other position. The arm is tapered in width from the anchored end toward the movable end, and has a relatively low mass. The arm is an elongated flat member in juxtaposition with the disc and extends diametrically across one face of the disc. The arm has a minimum influence on the thermal operating characteristics of the disc. The arm is in direct electrical contact with the conductive plate when in the first arm position for conducting low current therebetween. The arm is moved out of electrical contact with the conductive plate when in the second arm position for inhibiting current conduction therebetween.

The arm has a hardness greater than the plate and has a thin contacting portion at the movable end sufficiently narrow to penetrate surface contaminants on the plate and deformably engage the plate under the driving force of the disc. The contact portion in the preferred embodiment of the invention is an integral end length of the movable arm end portion projecting toward the plate and oriented for edgewise engagement with the surface of the plate. The arm has sufficient resiliency to flex under the impact of the movable end with the plate to cause the edge portion of the arm to wipe along the surface of the plate on impact.

An electronic switching means is provided for sensing when the arm is in the first arm position in electrical contact with the plate and for providing a separate, relatively high current conductive path in response thereto. The switch has a high current control capability with only low current conduction required through the arm and plate. As such, no separate current conducting contact need be carried by the arm.

The thermostatic switch includes a support frame which holds the conductive plate in position and an insulator positioned between the disc and the plate to hold the two in spaced-apart position. The frame has an electrically conductive portion loosely retaining the disc between the insulator and the conductive frame portion. When in its one dished configuration corresponding to the first arm position, the disc biases the arm into electrical contact with the plate and the disc into electrical contact with the conductive frame portion. This establishes an electrical path between the plate and the conductive frame portion when the arm is in the first position.

The insulator has an annular shape with a circumferential portion thereof sized to engage the disc along its perimeter and not inhibit movement of the arm between its two positions. The central aperture of the annular insulator is positioned relative to the arm to permit free movement of the arm into and out of electrical contact with the plate.

In the presently preferred embodiment of the invention, the switching means is a power transistor and is mounted on a circuit board positioned adjacent to the plate on a side opposite from the disc. The circuit board and the plate are electrically interconnected.

In a second embodiment of the invention, the switch includes a second conductive plate position on a side of the disc opposite the first plate, and a second contactless resilient arm fixedly attached at a perimeter portion of the disc and positioned to engage the second plate.

Other features and advantages of the invention will become apparent from the following detailed description, taken in conjunction with the accompanying drawings.

BRIEF DESCRIPTION OF THE DRAWINGS

FIG. 1 is a sectional perspective view of a thermostatic switch embodying the present invention.

FIG. 2 is a perspective view of the temperature sensing disc and arm embodying the present invention and used in the switch shown in FIG. 1.

FIG. 3 is an enlarged, fragmentary, sectional side elevational view of the switch shown in FIG. 1, with the temperature sensing disc in a concave position and the switch in an open state.

FIG. 4 is an enlarged, fragmentary, sectional side elevational view of the switch shown in FIG. 1, with the temperature sensing disc in a convex position and the switch in a closed state.

FIG. 5 is an electrical schematic diagram of the switch shown in FIG. 1 connected to a load.

BEST MODE FOR CARRYING OUT THE INVENTION

Figure 6:
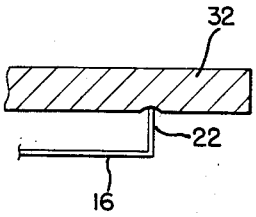
FIG. 6 is an enlarged, fragmentary, section side elevational view of the movable contact end of the arm shown engaging the conductive plate.

As shown in the drawings for purposes of illustration, the present invention uses a bimetallic disc 12, in a thermostatic switch 14. The disc 12 has a resiliently deformable body with two stable positions of opposite concavity and a characteristic of changing between its two oppositely dished configurations with a snap action in response to temperature change. The disc 12 is shown in FIG. 3 in the concave position and in FIG. 4 in the convex position.

A resilient, electrically conductive arm 16 has an anchored end portion 18 fixedly attached, such as by welding, to a perimeter portion 20 of the disc 12. The arm 16 further has a movable contact end portion 22 distal from the first end portion 18. The arm 16 is an elongated, flat member in juxtaposition with one face of the disc 12 and extends diametrically across that face of the disc. By reason of the fixed attachment of the anchored end portion 18 of the arm 16 to the perimeter portion 20 of the disc 12, the arm moves with the disc as it changes between its two oppositely dished configurations. This causes the movable contact end portion 22 of the arm 16 to move between first and second spaced-apart positions corresponding to the two dished configurations of the disc 12.

As best shown in FIG. 3, the anchored end portion 18 of the arm 16 is held immediately adjacent to the face of the disc 12. When the disc 12 is in the concave configuration, the disc pulls the arm 16 toward the disc and due to the resiliency of the arm, the arm tends to follow the disc contour. This holds the arm 16 nestled against the concave face of the disc 12 with the movable contact end portion 22 of the arm engaging the face of the disc.

The arm 16 is tapered in width from the anchored end portion 18 toward the movable contact end portion 22 and is sized and shaped to have a relatively low mass. The tapered design also reduces the mass of the arm 16 at the movable contact end portion 22 to provide a center of mass located toward the anchored portion 18 at which the arm is attached to the disc 12. As such, susceptibility to vibration and the mechanical loading force which the weight of the arm 16 applies to the disc 12 are substantially reduced when compared to conventional bimetallic discs operating with arms carrying heavy, precious metal electrical contacts.

The arm 16 uniformly tapers to a slightly squared-off tip at the second end portion 22 of the arm. The arm 16 is fabricated of a resilient, relatively hard metal such as stainless steel. In the presently preferred embodiment of the invention, the arm 16 has a 0.005 inch thickness and a 0.080 inch width at the anchored end portion 18 and a 0.040 inch width at the movable contact end portion 22.

As shown in FIG. 4, when the disc 12 moves to its convex configuration in response to the temperature increasing beyond the operating temperature of the disc, such movement being with a snap action, the arm 16 is positioned tangential to the convex face of the disc and is moved to reposition the movable contact portion 22 a significant distance above the face of the disc. While not shown, the arm 16 could be attached to the disc 12 with an angular orientation, such as generally perpendicular to the disc, which may require the orientation of the disc relative to the other components of the switch 14 to be changed accordingly. It is to be understood that the switch of the present invention may be manufactured with the arm 16 attached to the opposite face of the disc 12 such that the arm positions would be the reverse of that described herein with respect to the concavity of the disc.

As shown in FIGS. 1, 3 and 4, the thermostatic switch 14 includes a conductive, cylindrical case 24 having an insulated cap 26 fixedly attached at one end and a temperature sensing surface 28 at the opposite end intergrally formed as a part of the case. Rigidly attached to the temperature sensing surface 28 is a threaded mounting stud 30 which may be threadedly attached to the heat generating equipment or other object to which the thermostatic switch 14 is to be responsive.

Disposed within the case 24 toward the end with the temperature sensing surface 28 is a circular conductive plate 32. Positioned between the conductive plate 32 and the temperature sensing surface 28 is the disc 12. An electrically conductive, circumferentially extending interior shoulder 34 of the case 24 loosely retains the disc 12 in juxtaposition with the plate 32, with the face of the disc to which the arm 16 is attached facing the plate. The perimeter of the disc 12 on the side opposite the plate 32, engages the shoulder 34 and is in electrical contact therewith, particularly when the disc is in the convex configuration (FIG. 4). When in the convex configuration, the disc 12 biases the arm 16 into electrical contact with the plate 32 and the disc into electrical contact with the shoulder 34 to provide a good conductive path between the plate 32 and the case 24.

An annular insulator 36 is positioned between the plate 32 and the disc 12 and fixedly retains the plate in position. A second circumferentially extending interior shoulder 38 of the case 24 retains the insulator 36 in position. The insulator 36 has a radial sidewall to insulate plate 32 from the case 24 and a circumferentially extending, radially inward projecting portion sized to engage the perimeter portion 20 of the disc 12, on the side facing the plate 32, to hold the disc spaced apart from the plate and out of electrical contact therewith, but yet permit the arm 16 to move between its two positions uninhibited by the insulator. The disc 12 is thereby held in proper position adjacent to the plate 32, but with a minimal amount of mechanical loading on the disc in order to accomplish the positioning. The insulator 36 is spaced sufficiently far from the first shoulder 34 to allow the disc 12 to move freely relative to the plate 32 when in the concave configuration shown in FIG. 3.

Figure 7:
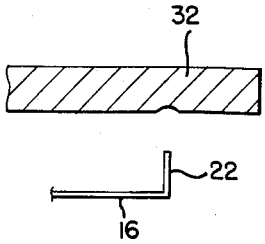
FIG. 7 is an enlarged, fragmentary, sectional side elevational view of the movable contact end of the arm shown disengaged from the conductive plate.

The movable contact end portion 22 of the arm 16 has an integral length thereof which projects a distance toward the plate 32 to edgewise engage and make electrical contact with the plate when the disc moves into its convex configuration. The disc 12 accelerates the arm 16 into engagement with the plate 32 as the disc changes concavity to the convex configuration. The force at which the arm 16 is propelled by the disc 12 and the thinness of the arm causes the edge portion of the arm to engage the plate and much like a knife edge, providing a concentrated pressure penetrates through any surface contaminants which may be present on the plate. The plate 32 is fabricated of metal softer than the arm 16, and due to the different hardness of the arm and the plate, the impact of the edge portion of the arm engaging the plate causes a scratch on the surface of the plate, as best shown in FIGS. 6 and 7 is somewhat exaggerated fashion. Upon impact, the drive force on the arm 16 is believed sufficient to momentarily bow the arm toward the plate 31 and cause the edge portion of the arm to wipe the surface of the plate, thereby further facilitating a good electrical contact between the arm and the plate. Since the disc 12 is loosely retained within the case 24, it is free to move when in the concave configuration and the natural tendency of the disc is to rotate with vibration. Hence the edge portion of the arm 16 does not repeatedly hit the plate 32 at the same spot. This causes the edge portion of the arm 16 to scribe a circular scratch on the plate 32.

In view of the low mass tapered design of the arm 16 and its leaf-spring action, the force the disc 12 applies to the arm both when the movable contact end portion 22 is in engagement with the plate 32 (FIG. 4) and with the face of the disc (FIG. 3), is sufficient to hold the arm tightly in position and prevent its vibration. This has been shown to produce a vibration insensitive switch with a natural frequency in excess of the frequencies typical for the operating environment in which such switches are used.

A circular circuit board 40 is mounted directly adjacent to the plate 32 on a side thereof opposite the disc 12 and is electrically interconnected with the plate. The assembly comprising the circuit board 40 and the insulator 36, with the plate 32 positioned therebetween, is held in fixed position within the case 24 by a spacer sleeve 42. The sleeve 42 is positioned against the interior sidewalls of the case 24 with one axial end wall of the sleeve engaging the circuit board 40 to sandwich the circuit board, plate 32 and insulator 36 between the end wall and the second shoulder 38. The opposite axial end wall of the sleeve 42 engages the interior of the cap 26 and is held against axial movement thereby.

As previously noted, the insulator 36 holds the disc 12 spaced apart from the plate 32 sufficiently to prevent the disc or the arm 16 from making electrical contact with the plate when the disc is in its concave configuration, as shown in FIG. 3. When the temperature rises to above the operating temperature of the disc 12, the disc changes to its convex configuration, as shown in FIG. 4, and the arm 16 moves toward the plate 32 to place the movable contact portion 22 of the arm into engagement and electrical contact therewith. In the presently preferred embodiment of the invention, the insulator 36 is of sufficient size to hold an elongated mid-portion 44 of the arm 16 at a spaced distance from the plate 32 when the disc 12 is in the convex configuration, and the projecting length of the movable contact portion 22 provides the necessary reach for the arm to make electrical contact with the plate. As will be described below, establishing an electrical path between the plate 32 and the first shoulder 34 of the case 24 through the arm 16 is important for operation of the switch 14.

Mounted on the circuit board 40 is an electronic switching means which is responsive to conduction of current between the arm 16 and the plate 32 for controlling a separate, relatively high current conductive path to which an electric load may be connected. The electronic switching means is activated by the temperature sensor 10, and in the presently preferred embodiment comprises a PNP power transistor 46. The case 24 of the switch 14 is grounded and, as shown schematically in FIG. 5, the temperature sensor 10 provides the ground to a current limiting resistor 48 connected to the base of the power transistor 46 when the disc 12 is in the convex configuration (FIG. 4). The ground provides a saturating base current to the power transistor 46. The emitter of the power transistor 46 is connected to a positive supply voltage and the collector of the power transistor is connected to the electrical load.

The power transistor 46 operates as a switch changing between a fully on conductive state and a fully off nonconductive state in response to the arm 16 contacting the plate 32 and conducting the base current necessary to saturate the power transistor. In the presently preferred embodiment of the invention, the arm 16 need conduct only a few milliamperes to provide a switching capability of several amperes. Consequently, use of separate precious metal contacts can be avoided and concern over contact surface resistance is eliminated. The low amperage used results in little power being dissipated even if high surface resistance is encountered. Although low currents are used, the dry circuit switching phenomena which usually requires use of gold coated contacts is of little concern because any surface contaminants, including contact surface oxidation, are penetrated and the surface wiped by the edge portion of the arm 16 as it engages the plate 32, as discussed in more detail above. These advantages are achieved using relatively inexpensive and readily available materials.

A pair of terminal rods 50 extend through the cap 26 to the interior of the case 24 and are electrically connected to a circuit (not shown) on the circuit board 40. The terminal rods 50 provide means for the connection of the supply voltage and the load to the switch 14. Typically the equipment or object to which the switch is attached would have a chassis ground and provide that ground to the switch 14 through the mounting stud 30.

The resistor 48 and the power transistor 46 are electrically and physically connected to the side of the circuit board 40 opposite the conductive plate 32 and are held protected within the case 24. The power transistor 46 is positioned adjacent to one of the terminal rods 50, and the rod acts as a heat sink for the transfer of heat generated by the power transistor to the environment.

With the above-described arrangement for the switch 14, the need for a separate contact carried by the disc arm 15 is eliminated since the arm need only conduct sufficient current to provide base drive to the power transistor. This not only eliminates the expense and weight of a separate contact, it also eliminates most mechanical loading forces on the disc 12, while still providing a switch with high current control capability. Concerns over contact resistance and contact chatter are eliminated. Switching of inductive loads can be handled without concern over contact wear as a result of arcing. Since the disc 12 is substantially relieved of the mechanical loading forces typically applied to the discs used in conventional thermostatic switches, the switch 14 can more nearly achieve the inherent thermal operating characteristics of the disc, producing a more accurate and repeatable performance and a more responsive and reliable switch. The switch 14 has a simple construction with an increased operating life since contact wear, a frequent reason requiring replacement of thermostatic switches, is eliminated. The low mass, tapered design of the disc arm 16 with an unweighted movable contact portion 22 and with the arm biased into yieldable engagement with the disc or plate during static conditions, renders the arms very insensitive to vibration. The low mass of the arm 16 relative to the stress forces of the disc 16 which affect the thermal operating characteristics of the disc, helps produce a switch 14 of superior performance.

Conventional thermostatic switches comparable to the switch of the present invention typically have a 60–100 gram force applied to the disc during switch operation. This force is necessary to achieve the desired current capacity, contact resistance, contact chatter, and vibration insensitivity. With the present invention, the force on the arm 16 can be reduced by nearly an order of magnitude to 6–10 grams. The standard accuracy of a comparable conventional thermostatic switch is $\pm 5°$ F. at the operating point, with a 15° F. minimum differential or hysteresis between the operating and reset temperatures. With the present invention, the accuracy has been improved to $\pm 2.5°$ F. and the minimum differential has been reduced to 8° F. Furthermore, a cost savings can be achieved by eliminating use of contacts and by the increased yield which results from the simpler and more easily manufactured construction of the switch 14 of the present invention. The switch 14 of the present invention has been shown to have superior life, being able to operatively cycle far beyond conventional bimetallic disc switches.

Figure 8:
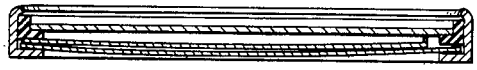
FIG. 8 is a sectional side elevational view of a second embodiment of the thermostatic switch of the present invention, with the temperature sensing disc, arm and contact plate assembled in a separate cylindrical case.

In a first alternative embodiment of the invention shown in FIG. 8, the disc 12, arm 16, plate 32 and insulator 36 are encased in a separate, shortened case 52 with open end faces 54. With this embodiment the mechanical components of the heat responsive portions of the switch can be packaged separately and inserted in a larger case containing the electronic switching circuit described above.

Figure 9:
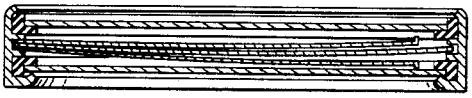
FIG. 9 is a sectional side elevational view of a third embodiment of the thermostatic switch of the present invention, similar to FIG. 8, with the disc having two arms.

A second alternative embodiment of the invention is shown in FIG. 9.

In a first alternative embodiment of the invention shown in FIG. 8, the disc 12, arm 16, plate 32 and insulator 36 are encased in a separate, shortened case 52 with open end faces 54. With this embodiment mechanical components of the heat responsive, low current switching portions of the switch can be packaged separately and inserted in a larger case containing the electronic switching circuit described above.

A second alternative embodiment of the invention is shown in FIG. 9. In this embodiment there is included a disc 12, having an arm 16 fixedly attached to each side of the disc. Spaced from each side of the disc 12 by the insulator 36 is the contact plate 32 for engagement by the corresponding arm 16. The purpose of this embodiment is to simultaneously provide a normally closed and a normally opened switch operated by the disc 12.

It will be appreciated that, although a specific embodiment of the invention has been described herein for purposes of illustration, various modifications may be made without departing from the spirit and scope of the invention. Accordingly, the invention is not limited except as by the appended claims.

I claim:

1. A thermostatic switch, comprising:

a conductive plate;

a bimetallic disc positioned adjacent to said plate and spaced therefrom, said disc being movable between two oppositely dished configurations with a snap action in response to changes in temperature; and an electrically conductive, resilient arm of a different metallic composition than said disc, said arm being fixedly attached by an anchored end to said disc at a perimeter portion thereof and having a movable contact end, said movable contact end having no separate contact element and moving with said disc between two positions corresponding to said disc configurations, said movable contact end yieldably engaging said plate in one position and said disc in the other position, whereby the natural frequency of said arm is increased and the vibration sensitivity of the switch is decreased.

2. The thermostatic switch of claim 1 wherein said arm has a thin contact portion at said movable contact end sufficiently narrow to penetrate surface contaminants on said plate and deformably engage said plate under the driving force of said disc.

3. The thermostatic switch of claim 2 wherein said arm has a metallic composition of greater hardness than said plate, and said contact area is an edge portion of said movable contact end projecting toward said plate.

4. The thermostatic switch of claim 3 wherein said arm has a sufficient resiliency to flex under the impact of said movable contact end with said plate to cause said edge portion to wipe along the surface of said plate on impact.

5. The thermostatic switch of claim 1 wherein said arm is tapered in width from said anchored end toward said movable contact end, and has a relatively low mass, whereby said arm has minimum influence on the thermal operating characteristics of said disc.

6. The thermostatic switch of claim 1 wherein said arm is an elongated, flat member in juxtaposition with said disc, said arm extending diametrically across the face of said disc toward said plate.

7. The thermostatic switch of claim 1 further including a second conductive plate positioned to a side of said disc opposite said first plate, and a second resilient arm of a different metallic composition than said disc and positioned between said disc and said second plate, said second arm being fixedly attached by an anchored end to said disc at a perimeter portion thereof and having a movable contact end, said movable contact end of said second arm having no separate contact element and moving with said disc between two positions corresponding to said disc configurations, said positions being oppositely oriented from said positions of said first arm, said movable contact end of said second arm yieldably engaging said disc in one position and said second plate in the other position.

8. The thermostatic switch of claim 1 further including electronic switching means for sensing when said arm is in said first arm position in electrical contact with said plate and for providing a separate and switched, relatively high current conductive path in response thereto, whereby the switch has a high current control capability with only low current conduction through said arm and plate such that no separate current carrying contact element need be carried by said arm.

9. A thermostatic switch, comprising:

a conductive plate;

a bimetallic disc positioned adjacent to said plate and having a resiliently deformable body with two stable positions of opposite concavity, said disc moving from one of said positions to the other in response to temperature change;

an electrically conductive, resilient arm of a metallic composition different from said disc and harder than said plate, said arm being fixedly attached by an anchor end portion to said disc at a perimeter portion thereof and having a movable contact end portion for movement with said disc between two spaced apart positions corresponding to said disc positions, said arm yieldably engaged and being in direct electrical contact with said conductive plate when in said first arm position for conducting low current therebetween and yieldably engaging said disc and being out of electrical contact with said conductive plate when in said second arm position for inhibiting current conduction therebetween, said movable contact end portion having no separate contact element and having a portion projecting toward said plate deformably engaging said plate under the driving force of said disc; and electronic switching means for sensing when said arm is in said first arm position in electrical contact with said plate and for providing a separate and switched, relatively high current conductive path in response thereto, whereby the switch has a high current control capability with only low current conduction through said arm and plate such that no separate current carrying contact element need be carried by said arm.

10. The thermostatic switch of claim 9 wherein said portion projecting toward said plate is an integral end length of said movable contact end portion oriented for edgewise engagement with the surface of said plate.

11. The thermostatic switch of claim 9 wherein said arm has sufficient resiliency to flex under impact of said movable contact end portion with said plate to cause said portion projecting toward said plate to wipe along the surface of said plate on impact.

12. The thermostatic switch of claim 9 wherein said arm is tapered in width from said anchored end toward said movable contact end, and has a relatively low mass.

13. The sensor of claim 9 wherein said arm is an elongated, flat member in juxtaposition with said disc, said arm extending diametrically across one face of said disc.

14. A thermostatic switch for connection to a load, comprising:

a support frame;

a conductive plate held in position by said frame;

a bimetallic disc held in spaced apart juxtaposition with said plate, said disc having a resiliently deformable body with two stable positions of opposite concavity, said disc moving from one of said positions to the other in response to temperature change;

an electrically conductive, resilient arm of a different metallic composition than said disc having an anchored end portion fixedly attached to a face of said disc toward said plate at a perimeter portion of said disc and having a movable contact position, said arm having no separate contact element and being movable with said disc between two spaced apart positions corresponding to said disc positions, said arm being moved into yieldable engagement and direct electrical contact with said conductive plate when in said first arm position for conducting low current therebetween and being moved out of yieldable engagement and electrical contact with said conductive plate when in said second arm position for inhibiting current conduction therebetween; and electronic switching means responsive to electrical contact of said arm with said conductive plate for controlling a separate, relatively high current conductive path to which the load is connectable.

15. The switch of claim 14 wherein said arm has a metallic composition of greater hardness than said plate, and said movable contact portion is movable with said disc between said two spaced apart positions, said contact portion having an integral end length oriented for edgewise engagement with the surface of said plate.

16. The switch of claim 14 wherein said arm tapers in width from said anchored end portion to a distal movable contact end portion, and said arm has a relatively low mass.

17. The switch of claim 14 wherein said disc is held spaced apart from said plate by an insulator positioned between said disc and said plate.

18. The switch of claim 17 wherein said frame has an electrically conductive portion loosely retaining said disc between said insulator and said conductive frame portion, said disc biasing said arm into electrical contact with said plate and said disc into electrical contact with said conductive frame portion when said disc moves to said position corresponding to said first arm position, whereby said disc is free to rotate relative to said plate when said arm is in said second position and an electrical path is established between said plate and said conductive frame portion when said arm is in said first position.

19. The switch of claim 18 wherein said insulator has an annular shape with a circumferential portion thereof sized to engage said disc along its perimeter, whereby movement of said arm between its two positions is not inhibited by said insulator.

20. The switch of claim 14 wherein said switching means is a power transistor.

21. The switch of claim 14 wherein said switching means is mounted on a circuit board positioned adjacent to said plate on a side opposite said disc, said circuit board and plate being electrically interconnected.

* * * * *